US005584703A

United States Patent [19]

Campbell

[11] Patent Number: 5,584,703

[45] Date of Patent: Dec. 17, 1996

[54] QUICK RELEASE INSULATOR FOR MALE OR FEMALE SPADE TERMINALS

[76] Inventor: Charles E. Campbell, 108 Cherry St., Box 853, Healdton, Okla. 73438

[21] Appl. No.: 518,299

[22] Filed: Aug. 23, 1995

[51] Int. Cl.[6] ..... H01R 13/44

[52] U.S. Cl. ..... 439/135; 439/131

[58] Field of Search ..... 439/131, 134, 439/135, 149, 892, 740, 460

[56] References Cited

U.S. PATENT DOCUMENTS

| | | | |
|---|---|---|---|
| 3,813,636 | 5/1974 | Mason | 439/460 OR |
| 4,050,757 | 9/1977 | Glaesel . | |
| 4,140,358 | 2/1979 | Marechal | 439/135 X |
| 4,235,497 | 11/1980 | Simon . | |
| 4,253,718 | 3/1981 | Bungo . | |
| 4,427,257 | 1/1984 | DeMarco | 439/892 OR |
| 4,571,017 | 2/1986 | Fujita . | |
| 4,660,914 | 4/1987 | Nakamura . | |
| 4,698,459 | 10/1987 | Drake | 439/892 X |

*Primary Examiner*—Gary F. Paumen
*Assistant Examiner*—Daniel Wittels
*Attorney, Agent, or Firm*—Joseph H. McGlynn

[57] ABSTRACT

The instant invention provides a quick release insulator for receiving and insulating a male or female electrical spade terminal when not in use. The insulator includes a substantially cylindrical housing. The housing has a first flat end and a second flat end and at least one slot passing through the first flat end. A metal spring is positioned within the housing. The spring has a first end for abutting against the flat surface within the housing nearest the second flat end and a second end with a substantially flat pressure plate mounted on it for biasing the exposed end of the terminal when it is inserted through the slot.

5 Claims, 1 Drawing Sheet

QUICK RELEASE INSULATOR FOR MALE OR FEMALE SPADE TERMINALS

BACKGROUND OF THE INVENTION

The instant invention relates to the art of electrical insulators and specifically to the art of quick release electrical spade terminals.

DESCRIPTION OF THE PRIOR ART

Electrical spade terminals are well known in the prior art. Exemplary of such devices are the following, all of which are incorporated herein by reference:

U.S. Pat. No. 4,050,757 to Glacial teaches a push on insulating sleeve for electrical spade terminal sockets of symmetrical cross-section which can be fitted to a socket in either of two orientations. The socket is located by symmetrical protuberances on the narrow sides at one end of the sleeve, and ratchet teeth spaced from the same end.

U.S. Pat. No. 4,253,718 to Bungo teaches an electrical connector comprising a connector body and a cable end attached terminal. The connector body has a flexible latch finger which engages a T-shaped lock projection of the terminal to retain the terminal in the connector body. The connector body also includes an integrally hinged flap which maintains the flexible latch finger in a terminal retaining position and which includes a pair of studs which provide a secondary lock for retaining the terminal in the cavity.

U.S. Pat. No. 4,571,017 to Fujita teaches an electrical connector assembly comprising a first connector having a first housing with spaced parallel side walls defining a terminal-receiving passageway therein and a terminal in the terminal-receiving passage. The housing is provided with a resilient arm extending outwardly from one of the opposed inner surfaces of the side walls and projects into the terminal-receiving passageway. The arm has a free end which is adapted to hold the terminal in the terminal-receiving passageway. A second connector has a second housing with spaced side walls which can be fitted in the side walls of the first housing. The second connector has another terminal arranged between the side walls thereof to be electrically connected to the terminal of the first connector. The resilient arm extends parallel to the associated side wall on which the resilient arm is formed and is spaced from the associated wall providing a space for receiving one of the side walls of the second housing between the associated wall and the resilient arm to limit the movement of the resilient arm in a direction away from the terminal when the second connector is mated with the first connector.

U.S. Pat. No. 4,660,914 to Nakamura teaches an insulating cover for a terminal. A cover body is composed of a synthetic resin formed into a sleeve. The cover body comprises a sleeve portion for receiving the head portion of the terminal which is connected to a wire and two fitting portions for enclosing the remaining portions of the terminal together with the wire. The two fitting portions are connected to the sleeve such as to be freely operated and closed at the connecting point. In the main portions, the fitting portions have engaging hooked pin portions and receiving hole portions for securely retaining the terminal.

U.S. Pat. No. 4,235,497 to Simon teaches a spring contact element comprising a metal spring leaf for mechanically fastening and electrically connecting it to the end of a cable and a contact spring to provide a plug-in connection with a counter contact element. The contact spring includes a base leg attached to a fastening means and passes, at the plug-in end of the spring contact element. via a bend having a predetermined bending radius, into a free end leg describing an acute angle with the base leg, and an insulating case for such spring contact element. A first contact chamber to receive the spring contact element through an opening in a first front side and a second contact chamber to receive the counter contact element from the second front side facing the first front side are provided. The broad side of the cross-section of the second contact chamber is twisted about ninety degrees (90°) against the broadside of the cross section of the first connector chamber. The two contact chambers penetrate each other symmetrically.

Other than the application of electrical tape to the exposed male and/or female electrical spade contacts when not in use, the prior art provides no safe, effective and reliable way to insulate such exposed contacts.

Thus, it is an object of the instant invention to correct the long-recognized unsafe practice of insulating exposed male or female electrical spade connectors only with electrical tape.

It is a further object of the instant invention to provide a device which can be easily, quickly, safely and reliably applied to an exposed male or female electrical spade connector so as to render it safe to electrical workers.

It is a further object of the instant invention to provide a device which promotes safety in the electrical industry, and which is simple and inexpensive to manufacture.

These and other objects will become apparent from the following disclosure.

SUMMARY OF THE INVENTION

The instant invention provides a quick release insulator for receiving and insulating a male or female electrical spade terminal when not in use. The insulator includes a substantially cylindrical housing, although other shapes could be used. Preferably, the housing is constructed of substantially any suitable plastic, known to the prior art. The housing has a first flat end and a second flat end and at least one slot passing through the first flat end. A metal spring is positioned within the housing. The spring has a first end for abutting against the flat surface within the housing nearest the second flat end and a second end with a substantially flat plastic or metal pressure plate mounted on it for biasing the exposed end of the terminal when it is inserted through the slot.

In a preferred embodiment of the instant invention, the slot comprises a single slot designed, sized and spaced for receiving a male spade terminal and enabling it to be locked within the housing by fully inserting it through the slot into the housing and rotating it through an angle of more than about zero degrees (0°) but less than about one hundred and eighty degrees (180°).

In a second preferred embodiment the slot comprises a single slot designed, sized and spaced for receiving a female spade terminal and enabling it to be locked within the housing by fully inserting it through the slot into the housing and rotating it through an angle of more than about zero degrees (0°) but less than about one hundred and eighty degrees (180°).

In a third preferred embodiment, first and second slots are provided, which intersect each other through their linear centers. The slots are displaced from each other at an angle of about ninety degrees (90°). The first slot is designed, sized and spaced for receiving a male spade terminal and enabling it to be locked within the housing by fully inserting it through the slot into the housing and rotating it through an angle of more than about zero degrees (0°) but less than about ninety degrees (90°) or less than about one hundred eighty degrees (180°) but more than about ninety degrees (90°). The second slot is designed, sized and spaced for receiving a female spade terminal and enabling it to be locked within the housing by fully inserting it through the slot into the housing and rotating it through an angle of more than about zero degrees (0°) but less than about ninety degrees (90°) or less than about one hundred eighty degrees (180°) but more than about ninety degrees (90°).

DETAILED DESCRIPTION

Figure 1:
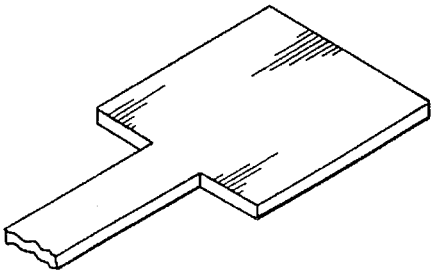
FIG. 1 (PRIOR ART)
FIG. 1 shows a partial isometric view of a prior art electrical male spade connector.
Figure 2:
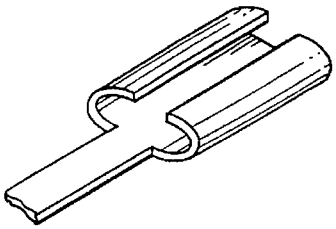
FIG. 2 (PRIOR ART)
FIG. 2 shows a partial isometric view of a prior art electrical female spade connector.

FIG. 1 and FIG. 2 show the prior art electrical male and female spade connectors, respectively.

Figure 3:
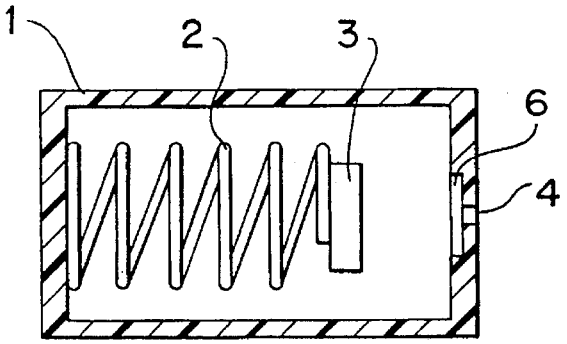
FIG. 3 shows a cutaway side view of the device of the instant invention exposing the spring of the invention.

FIG. 3 shows a cutaway side view of the device of the instant invention exposing the spring of the invention. The housing 1, includes slot 4 and houses spring 2. Pressure plate 3 is attached to one end of spring 3 for biasing the exposed end of a male or female connector when it is inserted into chamber 1 through slot 4.

Figure 4:
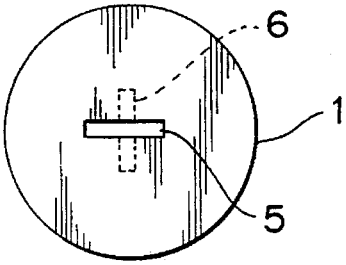
FIG. 4 shows the slotted end view of the device of the instant invention.

FIG. 4 shows the slotted end view of housing 1 of FIG. 3. Slot 5 can be designed, spaced and dimensioned to accommodate either a male or female electrical spade connector as disclosed above in the first and second disclosed embodiments. Phantom slot 6 depicts the latching slot that the spade connector will be pushed into by the spring 2 after the spade connector is inserted into slot 5 and turned and released. The slot 6 will prevent the spade from accidentally being aligned with slot 5 and being ejected from the housing 1 by the spring 2.

Figure 5:
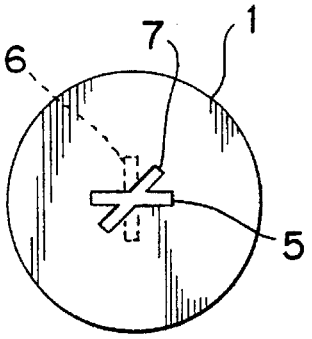
FIG. 5 shows the slotted end view of the device of the instant invention with a separate slot for the female spade connector and a slot for the male spade connector.

In FIG. 5 another embodiment is shown wherein there are two slots in the end of housing 1. One slot 5 is dimensioned to receive a male connector and the other slot 7 is larger to receive a female connector. In all other respects the embodiment of FIG. 5 works the same as the embodiment in FIG. 4.

Although the invention has been described with reference to certain preferred embodiments, it will be appreciated that many variations and modifications may be made within the scope of the broad principles of the invention. Hence, it is intended that the preferred embodiments and all of such variations and modifications be included within the scope and spirit of the invention, as defined by the following claims.

I claim:

1. A quick release insulator for insulating a spade terminal when said spade terminal is not in use comprising:

a housing having a first end and a second end, said first end having at least one slot means extending there through for receiving said spade terminal into said housing, biasing means positioned within said housing and having a first end mounted adjacent said second end of said housing, said biasing means having a second end positioned adjacent said first end of said housing, said biasing means second end engages said spade terminal when said spade terminal is positioned within said housing and exerts a force against said spade terminal which tends to force said spade terminal out of said housing, means within said housing on said first end of said housing for holding said spade terminal within said housing.

2. The insulator of claim 1, wherein said at least one slot means comprises a single slot designed, sized and spaced for receiving a male spade terminal and enabling locking thereof within said housing by fully inserting said male terminal through said single slot into said housing and rotating said male terminal through an angle of more than about zero degrees (0°) but less than about one hundred and eighty degrees (180°).

3. The insulator of claim 1, wherein said at least one slot comprises a single slot designed, sized and spaced for receiving a female spade terminal and enabling locking thereof within said housing by fully inserting said female terminal through said single slot into said housing and rotating said female terminal through an angle of more than about zero degrees (0°) but less than about one hundred and eighty degrees (180°).

4. The insulator of claim 1, wherein said at least one slot comprises first and second slots which intersect each other through the linear centers thereof and are displaced from each other at an angle of about ninety degrees (90°), wherein said first slot is designed, sized and spaced for receiving a male spade terminal and enabling locking thereof within said housing by fully inserting said male terminal through said first slot into said housing and rotating said male terminal through an angle of more than about zero degrees (0°) but less than about ninety degrees (90°) or less than about one hundred eighty degrees (180°) but more than about ninety degrees (90°), and said second slot is designed, sized and spaced for receiving a female spade terminal and enabling locking thereof within said housing by fully inserting said female terminal through said slot into said housing and rotating said female terminal through an angle of more than about zero degrees (0°) but less than about ninety degrees (90°) or less than about one hundred eighty degrees (180°) but more than about ninety degrees (90°).

5. The insulator of claim 1, wherein said biasing means comprises a metal spring.

* * * * *